US009394580B2

(12) United States Patent
Lee et al.

(10) Patent No.: US 9,394,580 B2
(45) Date of Patent: Jul. 19, 2016

(54) HIGH-TOUGHNESS COLD-DRAWN NON-HEAT-TREATED WIRE ROD, AND METHOD FOR MANUFACTURING SAME

(75) Inventors: You-Hwan Lee, Pohang-si (KR); Dong-Hyun Kim, Pohang-si (KR)

(73) Assignee: POSCO, Pohang-si (KR)

( * ) Notice: Subject to any disclaimer, the term of this patent is extended or adjusted under 35 U.S.C. 154(b) by 630 days.

(21) Appl. No.: 13/824,667

(22) PCT Filed: Nov. 21, 2011

(86) PCT No.: PCT/KR2011/008883

§ 371 (c)(1), (2), (4) Date: Mar. 18, 2013

(87) PCT Pub. No.: WO2012/067473

PCT Pub. Date: May 24, 2012

(65) Prior Publication Data

US 2013/0174947 A1 Jul. 11, 2013

(30) Foreign Application Priority Data

Nov. 19, 2010 (KR) ..... 10-2010-0115754

(51) Int. Cl.

| | |
|---|---|
| ***C21D 7/10*** | (2006.01) |
| ***C21D 8/06*** | (2006.01) |
| ***B21C 1/00*** | (2006.01) |
| ***C21D 7/00*** | (2006.01) |
| ***C21D 9/52*** | (2006.01) |
| ***C22C 38/04*** | (2006.01) |
| ***C22C 38/38*** | (2006.01) |
| ***C22C 38/02*** | (2006.01) |

(52) U.S. Cl.

CPC ..... *C21D 8/065* (2013.01); *B21C 1/003* (2013.01); *C21D 7/00* (2013.01); *C21D 7/10* (2013.01); *C21D 9/525* (2013.01); *C22C 38/02* (2013.01); *C22C 38/04* (2013.01); *C22C 38/38* (2013.01)

(58) Field of Classification Search

CPC ..... C21D 8/065; C22C 38/02; C22C 38/04

See application file for complete search history.

(56) References Cited

U.S. PATENT DOCUMENTS

| | | | | |
|---|---|---|---|---|
| 4,578,124 | A * | 3/1986 | Yutori | C21D 1/185 148/320 |
| 5,141,570 | A * | 8/1992 | Yutori | C21D 8/06 148/320 |
| 6,264,759 | B1 | 7/2001 | Bae et al. | |

(Continued)

FOREIGN PATENT DOCUMENTS

| | | |
|---|---|---|
| CN | 1251865 A | 5/2000 |
| JP | 01-139719 | 6/1989 |

(Continued)

*Primary Examiner* — Veronica F Faison

(74) *Attorney, Agent, or Firm* — The Webb Law Firm

(57) ABSTRACT

Provided is a wire rod for use in mechanical structure connections, vehicle components, or the like, and more particularly, to a wire rod which has superior toughness without being subjected to a heat treatment, and the strength of which is ensured through a cold-drawing process. Tot his end, provided are a high-toughness cold-drawn non-heat-treated wire rod and a method for manufacturing the same, wherein the wire rod comprises in % by weight: 0.2 to 0.3% of carbon (C), 0.1 to 0.2% of silicon (Si), 2.5 to 4.0% of manganese (Mn), 0.035% or less (but not 0%) of phosphorus (P), 0.04% or less (but not 0%) of sulfur (S), the remainder being iron (Fe) and unavoidable impurities.

7 Claims, 4 Drawing Sheets

(56) References Cited

U.S. PATENT DOCUMENTS

| | | | | |
|---|---|---|---|---|
| 6,475,306 | B1 | 11/2002 | Kanisawa et al. | |
| 2012/0037283 | A1 * | 2/2012 | Kim | C22C 38/001 148/598 |
| 2012/0118443 | A1 * | 5/2012 | Lee | C21D 8/06 148/645 |

FOREIGN PATENT DOCUMENTS

| | | | | |
|---|---|---|---|---|
| JP | 02-305937 | | 12/1990 | |
| JP | 07054040 | A | 2/1995 | |
| JP | 08-003640 | | 1/1996 | |
| JP | 10008209 | A | 1/1998 | |
| JP | 11-012689 | | 1/1999 | |
| JP | 2000129393 | A | 5/2000 | |
| JP | 2001200332 | A | 7/2001 | |
| JP | 2001-234242 | | 8/2001 | |
| JP | 2005-133152 | | 5/2005 | |
| JP | 2006118014 | A | 5/2006 | |
| JP | 2006-152406 | | 6/2006 | |
| JP | 2008-163410 | | 7/2008 | |
| KR | 100833079 | B1 | 5/2008 | |
| KR | 20090057564 | A | 6/2009 | |
| KR | 2009-0069872 | | 7/2009 | |
| KR | 20100116991 | A | 11/2010 | |
| KR | WO 2011016676 | A2 * | 2/2011 | C21D 8/06 |

* cited by examiner

HIGH-TOUGHNESS COLD-DRAWN NON-HEAT-TREATED WIRE ROD, AND METHOD FOR MANUFACTURING SAME

TECHNICAL FIELD

The present invention relates to a wire rod for use in mechanical structure connections, vehicle components, or the like, and more specifically, to a non-heat treated wire rod having excellent toughness, in which even in the case that a heating operation is omitted, strength may be secured through a cold drawing process, and a method for manufacturing the same.

BACKGROUND ART

Most structural steels used as components of mechanical structures and vehicles are quenched and tempered steels obtained by increasing strength and toughness through reheating, quenching, and tempering after hot working. On the contrary, a non-heat treated steel is a steel that does not undergo a heat treatment after hot working, but has a similar toughness and strength to a steel that has undergone a heat treatment (heat treated steel). Non-heat treated steel may be also called a "micro-alloyed steel" since the quality of the material is obtained by adding a very small amount of an alloying element.

Generally, a typical wire rod product is produced as a final product through the operations of Hot Rolling→Cold Drawing→Spheroidization Heat treatment→Cold Drawing→Cold Forging→Quenching and Tempering, whereas a non-heat treated steel is produced through the operations of Hot Rolling→Cold Drawing→Cold Forging→Product.

As described above, the non-heat treated steel is an economical product that may be produced without heat treatment and at the same time, does not undergo a final quenching and tempering process. Therefore, non-heat treated steel has been applied to many products due to the securing of linearity obtained by not generating heating deflections, i.e., defects caused during heating.

However, since the heat treatment process is omitted and cold working is continuously applied, as the processes progress, the strength of the product is further increased, while ductility is continuously decreased. To solve such drawbacks, the following techniques are disclosed.

Japanese Patent Laid-Open Publication No. 1995-054040 discloses a method for providing a non-heat treated steel wire rod with 750-950 MPa of tension by hot rolling the alloy steel that is composed of C: 0.1-0.2%, Si: 0.05-0.5%, Mn: 1.0-2.0%, Cr: 0.05-0.3%, Mo: 0.1% or less, V: 0.05-0.2%, Nb: 0.005-0.03%, and the remainder Fe, as a percentage by weight, cooling the alloy steel within 60 seconds between 800-600° C. for a cooling operation, and heating at 450-600° C., or cooling the alloyed steel after continuously maintaining it at a temperature of between 600-450° C. for at least 20 minutes, and then cold working. However, the product is hot-rolled through a process known as controlled rolling, and relatively expensive components such as chromium (Cr), molybdenum (Mo), vanadium (V), and the like are added in the method as mentioned above, so that it is uneconomical in practical use.

In addition, Japanese Patent Laid-Open Publication No. 1998-008209 relates to non-heat treated steel with excellent strength after hot working, and excellent cold formability and a method for manufacturing the same, and a method for preparing a forging member by using a non-heat treated steel, and also relates to non-heat treated steel with excellent cold formability, in which a volume of a ferrite phase is at least 40%, and a hardness is 90 HRB or less, for the steel having a controlled contents of carbon (C), silicon (Si), manganese (Mn), Cr, V, phosphorus (P), oxygen (O), sulfur (S), tellurium (Te), lead (Pb), bismuth (Bi), and calcium (Ca). Specifically, the document relates to a method for continuously cooling to an Al point temperature or less at cooling rate of 120° C. or less per minute, immediately after hot-rolling at 800-950° C. during a final working temperature, a method for cooling a hot rolled steel material in the air after heating for at least 10 minutes at 800-950° C., and also, a method for preparing a structural member with 20-35 HRB of hardness by cold working or warm working at a temperature of 600° C. or less, preparing a preform, and air cooling after hot-forging the preform at 1000-1250° C. However, the technology is limited to a specific steel containing elements that are usually not used, and is not applied to cold forging.

In addition, Japanese Patent Laid-Open Publication No. 2006-118014 provides a method for manufacturing case-hardened steel that is suitable for a bolt, and the like, which suppresses grain coarsening after heat treatment, even if cold formability is excellent and also, working with a high cutting rate of an expanded line is performed. The method as mentioned above uses the steel material that is composed of C: 0.1-0.25%, Si: 0.5% or less, Mn: 0.3-1.0%, P: 0.03% or less, S: 0.03% or less, Cr: 0.3-1.5%, aluminum (Al): 0.02-0.1%, N: 0.005-0.02%, the remainder iron (Fe), and other inevitable impurities, as a percentage by weight, and the method for manufacturing non-heat treated wire rod with excellent toughness is achieved by performing hot finish rolling or hot finish forging at 700-850° C., then cooling by up to 600° C. at a cooling rate of 0.5° C./sec or less, and suppressing a cut rate of an expanded line to below 20% by cooling to room temperature. The technology as mentioned above discloses the use of a small amount of Mn, and the use of Cr and Al.

DISCLOSURE

Technical Problem

An aspect of the present invention provides a high toughness cold-drawn non-heat treated wire rod that may allow for control of tensile strength through cold drawing and has excellent toughness, and a method for manufacturing the same.

According to an aspect of the present invention, there is provided a high toughness cold-drawn non-heat treated wire rod including carbon (C): 0.2-0.3%, silicon (Si): 0.1-0.2%, manganese (Mn): 2.5-4.0%, phosphorus (P): 0.035% or less (except 0), sulfur (S): 0.04% or less (except 0), the remainder iron (Fe), and other inevitable impurities, as a percentage by weight.

According to another aspect of the present invention, there is provided a method for manufacturing a high toughness cold-drawn non-heat treated wire rod, including heating a billet that includes C: 0.2-0.3%, Si: 0.1-0.2%, Mn: 2.5-4.0%, P: 0.035% or less (except 0), S: 0.04% or less (except 0), the remainder Fe, and other inevitable impurities, as a percentage by weight, within a temperature range of $A_{e3}$+150° C. to $A_{e3}$+250° C.;

cooling the heated billet at a cooling rate of 5-15° C./s; and rolling the cooled billet within a temperature range of $A_{e3}$+50° C. to $A_{e3}$+150° C.; and cooling the rolled steel to a temperature of 600° C. or less.

The present invention can provide a non-heat treated wire rod that can secure excellent high toughness even if a heat treatment is omitted, and in particular, can control tensile strength only through cold drawing, and can effectively manufacture parts for vehicles requiring high degrees of toughness, for example, a tie rod, a rack bar, etc. through this non-heat treated wire rod.

DETAILED DESCRIPTION OF THE INVENTION

Figure 1:
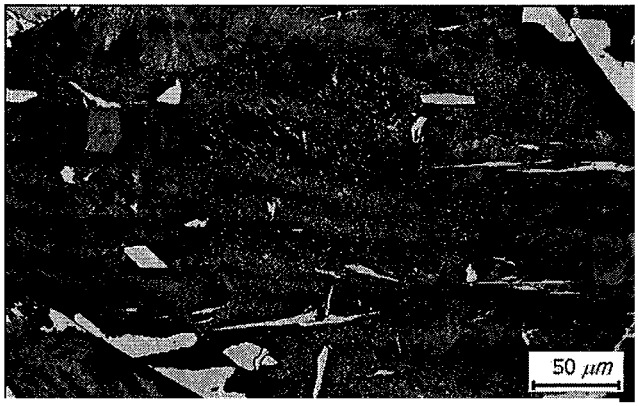
FIG. 1 shows the microstructure of Inventive Example 3 in Embodiment 2.

Hereinafter, the present invention will be described in detail.

The present inventors perceived that unlike existing techniques, a carbon diffusion suppression effect is generated by increasing the content of Mn and controlling the cooling rate during the manufacturing process, to thus form de-generated pearlite different from existing pearlite, and which is therefore capable of enhancing toughness, especially impact toughness, and they thereby completed the present invention.

First, the composition of a wire rod of the present invention will be described in detail (hereinafter, weight %). The composition of the wire rod of the present invention is characterized in that excellent toughness may be secured even if a high price element is not particularly added.

Carbon (C) content is preferably provided in a range of 0.2-0.3%. C is an element having an influence on the strength of the wire rod, and is added in an amount of 0.2% or more so as to secure sufficient strength. However, when a C content is excessive, the tendency for a ferrite and pearlite microstructure being formed is also increased, and thus more strength than is required is secured, thereby degrading toughness. Therefore, the C content is preferably limited to 0.3 wt % or less.

Silicon (Si) is preferably within a range 0.1-0.2%. To solve deterioration of workability due to sharp increase in work-hardening during cold drawing and forging, a Si content should be preferably 0.2% or less. When the Si content is so low, there is a problem in that the strength level that is required for hot rolled steel and the final product cannot be reached. Therefore, the Si content is preferably limited to not less than 0.1%.

Manganese (Mn) is preferably within a range of 2.5-4.0%. Mn is an element for solid solution strengthening that forms substitutional solid solutions in a matrix. For this reason, Mn is a useful element that may secure a required degree of strength without any deterioration of ductility. When a Mn content exceeds 4.0%, ductility decreases sharply due to Mn segregation, rather than the effect of solid solution strengthening. That is, when the Mn content is excessive, macro segregation and micro segregation easily occur according to a segregation mechanism during the solidification of steel to form a segregation zone due to a relatively low diffusion coefficient as compared to other elements, and the formed segregation zone becomes a major cause of forming a low temperature structure (core martensite) in a core portion, so that strength increases but ductility decreases. Also, when the Mn content is less than 2.5%, there is little effect on the segregation zone due to the segregation of Mn, but it is hard to sufficiently secure de-generated pearlite which is required in the present invention, and it is also hard to secure excellent cold drawability.

Phosphorus (P) and sulfur (S) are preferably present in ranges of not more than 0.035% (except 0) and of not more than 0.40% (except 0), respectively. Since P is a major cause of deteriorated toughness by segregation into grain boundaries, the upper limit of P is limited to 0.035%. Since S is a low melting point element and segregates into grain boundaries to deteriorate toughness and form sulphides, thus having a harmful influence on the properties of delayed fracture resistance and stress relaxation, the upper limit of S content is preferably limited to 0.040%.

The remainder includes iron (Fe) and unavoidable impurities. It is not intended that the wire rod of the present invention is entirely free of any element other than the above-mentioned elements.

Hereinafter, the microstructure of the wire rod of the present invention will be described in detail.

The wire rod of the present invention includes pearlite having an area fraction of not less than 90%, and the remainder, ferrite. The pearlite has de-generated pearlite including cementite having a thickness of not more than 100 nm. The de-generated pearlite has an aspect ratio of not more than 30:1 (width:thickness) which is an average aspect ratio of cementite, and forms a lamella structure having a lamella ferrite form together with partially segmented cementite.

In the present invention, since as the Mn content increases, C activity decreases, and a non-equilibrium structure, i.e., de-generated pearlite, may be formed. Mn segregates into grain boundaries between ferrite and austenite to suppress decomposition of austenite, so that non-equilibrium phase appears due to a dragg effect.

The thickness of cementite is known as lamellar spacing. In the present invention, when lamellar spacing is not more than 100 nm, cementite becomes non-uniform, and thus it becomes possible to form de-generated pearlite through de-generated lamellar.

The aspect ratio of cementite constituting the de-generated pearlite is 30:1 or less because cementite does not form uniform lamellar structures but is spheroidized to form de-generated lamellar. For this reason, when an impact is applied to the segmented cementites, impact energy does not pass through cementite but passes between the segmented cementites. Therefore, it is possible to enhance the impact value. However, when the aspect ratio exceeds 30:1, the lamellar of cementite is uniform. Therefore, it is hard to enhance the impact value.

Hereinafter, a method for manufacturing a wire rod according to the present invention will be described in more detail.

A billet satisfying the composition is heated. The heating of the billet is preferably performed within a temperature range of $A_{e3}$+150° C. to $A_{e3}$+250° C. For example, the heating is preferably performed for 30 minutes to 1 and a half hours.

By heating the billet within the temperature range mentioned above, austenite single phase may be maintained, austenite grain coarsening may be prevented, and a remained segregation, carbide, and inclusion can be effectively dissolved. When the heating temperature of the billet exceeds $A_{e3}$+250° C., the austenite grain is largely coarsened, so that the wire rod with a high strength and excellent toughness may not be obtained because the final microstructure formed after cooling has a strong tendency to be coarsened. On the other hand, when a heating temperature of the billet is below $A_{e3}$+150° C., the heating effect may not be achieved.

When the heating time is below 30 minutes, there is a problem in that the overall temperature may not be even; when the heating time exceeds 1 and a half hours, the austenite grain is coarsened, and productivity is significantly decreased. Accordingly, it is preferable that the heating time does not exceed 1 and a half hours.

It is preferable that the heated billet is cooled at a cooling rate of 5-15° C./s and is rolled within a temperature range of $A_{e3}$+50° C. to $A_{e3}$+150° C./s.

The cooling rate is limited with the object of minimizing the transformation of microstructure in the cooling operation before hot rolling. When the cooling rate before hot rolling is below 5° C./s, the productivity thereof is reduced, and additional equipment is needed in order to maintain air-cooling. In addition, as in the case of maintaining the heating time for a long period, the strength and toughness of the wire rod after completing hot rolling may be deteriorated. On the other hand, when the cooling rate exceeds 15° C./s, the possibility of new microstructures being formed during rolling is increased by increasing the driving force of the transformation of the billet before rolling, and serious problems in which the rolling temperature should be reset to a lower temperature may be caused. Therefore, the cooling rate is preferably set to 15° C./s or less.

Rolling after cooling in the temperature range of $A_{e3}$+50° C. to $A_{e3}$+100° C. suppresses the appearance of microstructures due to transformation during rolling, so that re-crystallization does not occur and only sizing rolling is possible. When the rolling temperature is below $A_{e3}$+50° C., the intended microstructures in the present invention are difficult to acquire because the rolling temperature is close to the dynamic re-crystallization temperature, and the possibility of securing a general soft ferrite is very high. On the other hand, when the rolling temperature exceeds $A_{e3}$+100° C., there is a problem that re-heating is needed after cooling.

The wire rod manufactured through the rolling is preferably cooled down to 600° C. or less at a cooling rate of 0.01-0.25° C./s. The cooling rate means a cooling rate that may very effectively produce de-generated pearlite and prevent C diffusion by adding Mn. When the cooling rate is below 0.01° C./s, since the cooling rate is too slow, the lamella or de-generated pearlite may not be produced, and cementite with a spheroidized form is produced, so that the strength thereof is sharply decreased. On the other hand, when the cooling rate exceeds 0.25° C./s, a low temperature structure is produced due to a large amount of Mn. Since the addition of Mn enhances hardenability to delay ferrite/pearlite transformation, thus producing a low temperature structure, such as martensite/bainite, it may not be expected to secure excellent cold drawability, impact toughness and ductility.

The wire rod of the present invention has a tensile strength ranging from 650 MPa to 750 Mpa, a cross-section reduction rate ranging from 60% to 70%, a tensile strength after manufacturing of the wire rod and cold drawing of about 95%, ranging from 1300 Mpa to 1500 Mpa, and a V-notch charpy impact toughness of 60 J or more.

Best Mode for Carrying Out the Invention

Hereinafter, the present invention will be described in detail with reference to the following Examples. The present invention is, however, not limited by the following Examples.

Example 1

Wire rods were manufactured with billets satisfying the compositions as described in Table 1, according to the manufacturing conditions as described in Table 2. Tensile strength and impact toughness in the manufactured wire rods were specified, and measurement results thereof are shown in Table 2.

TABLE 1

| Item | C (wt %) | Si (wt %) | Mn (wt %) | P (wt %) | S (wt %) | $A_{e3}$ (° C.) |
|---|---|---|---|---|---|---|
| Inventive Wire Rod 1 | 0.20 | 0.10 | 2.5 | 0.035 | 0.040 | 842 |
| Inventive Wire Rod 2 | 0.20 | 0.15 | 2.9 | 0.031 | 0.031 | 838 |
| Inventive Wire Rod 3 | 0.25 | 0.14 | 3.5 | 0.021 | 0.022 | 836 |
| Inventive Wire Rod 4 | 0.30 | 0.20 | 4.0 | 0.027 | 0.039 | 835 |
| Comparative Wire Rod 1 | 0.14 | 0.11 | 1.9 | 0.031 | 0.023 | 863 |
| Comparative Wire Rod 2 | 0.22 | 0.05 | 1.8 | 0.030 | 0.032 | 855 |
| Comparative Wire Rod 3 | 0.21 | 0.10 | 1.5 | 0.031 | 0.039 | 851 |
| Comparative Wire Rod 4 | 0.34 | 0.20 | 3.4 | 0.029 | 0.034 | 833 |
| Comparative Wire Rod 5 | 0.35 | 0.19 | 2.6 | 0.029 | 0.028 | 829 |

TABLE 2

| Item | Heating temp. and time of billet (° C., min) | Cooling rate of billet (° C./s) | Rolling temp. of billet (° C.) | Cooling rate after rolling (° C./s) | Tensile strength (MPa) | V-impact toughness (J) |
|---|---|---|---|---|---|---|
| Inventive Wire Rod 1 | 1082, 80 | 9.7 | 989 | 0.01 | 652 | 256 |
| Inventive Wire Rod 2 | 1038, 79 | 10.2 | 972 | 0.09 | 663 | 248 |
| Inventive Wire Rod 3 | 1036, 88 | 10.6 | 976 | 0.16 | 678 | 252 |
| Inventive Wire Rod 4 | 1035, 71 | 9.5 | 962 | 0.25 | 702 | 234 |
| Comparative Wire Rod 1 | 1063, 82 | 7.5 | 1055 | 0.005 | 520 | 340 |
| Comparative Wire Rod 2 | 1055, 89 | 8 | 998 | 0.005 | 558 | 352 |
| Comparative Wire Rod 3 | 1051, 75 | 9.3 | 965 | 0.008 | 589 | 312 |
| Comparative Wire Rod 4 | 1033, 69 | 12.1 | 980 | 1.0 | 892 | 46 |
| Comparative Wire Rod 5 | 1029, 68 | 11.5 | 968 | 0.9 | 920 | 13 |

As seen from the results of Table 2, Inventive Wire Rods have to have a tensile strength ranging from 650 MPa to 750 MPa. This range shows an increase in strength during cold drawing, and an optimal tensile strength range directly after hot rolling according to continuous decrease in toughness.

Therefore, it is not easy for Comparative Wire Rods 1 to 3 to secure a sufficient degree of strength, and it is difficult for Comparative Wire Rods 4 and 5 to secure sufficient cold drawability.

Example 2

Meanwhile, preferred tensile strength and impact characteristic were observed while varying the cooling rate after hot rolling. For this purpose, billets for Inventive Wire Rods 1 and 2 were applied to the process of Table 3 to specify tensile strength and impact toughness, and measurement results thereof are shown in Table 3. More preferred cooling rate condition may be confirmed through the results of Table 3.

TABLE 3

| Item | Heating temp. and time of billet (° C., min) | Cooling rate of billet (° C./s) | Rolling temp. of billet (° C.) | Cooling rate after rolling (° C./s) | Tensile strength (MPa) | V-impact toughness (J) | Note |
|---|---|---|---|---|---|---|---|
| Inventive Wire Rod 1 | 1082, 80 | 9.7 | 989 | 1.3 | 652 | 256 | Inventive Example |
| Inventive Wire Rod 1-1 | 1090, 62 | 13.2 | 956 | 0.2 | 531 | 326 | Inventive Example |
| Inventive Wire Rod 1-2 | 1015, 71 | 11.9 | 978 | 0.5 | 653 | 261 | Inventive Example |
| Inventive Wire Rod 1-3 | 1065, 65 | 10.2 | 988 | 0.9 | 676 | 235 | Inventive Example |
| Inventive Wire Rod 1-4 | 1111, 88 | 9.6 | 990 | 1.5 | 681 | 221 | Inventive Example |
| Inventive Wire Rod 1-5 | 1093, 78 | 13.9 | 991 | 2.3 | 897 | 32 | Inventive Example |
| Inventive Wire Rod 2 | 1038, 79 | 10.2 | 972 | 0.8 | 663 | 248 | Inventive Example |
| Inventive Wire Rod 2-1 | 1082, 82 | 11.7 | 965 | 0.3 | 546 | 365 | Inventive Example |
| Inventive Wire Rod 2-2 | 1053, 82 | 12.4 | 978 | 0.6 | 659 | 223 | Inventive Example |
| Inventive Wire Rod 2-3 | 1065, 89 | 10.2 | 981 | 1.1 | 675 | 232 | Inventive Example |
| Inventive Wire Rod 2-4 | 1071, 79 | 9.1 | 980 | 1.7 | 873 | 41 | Comparative Example |
| Inventive Wire Rod 2-5 | 1069, 80 | 14.2 | 968 | 1.9 | 901 | 15 | Comparative Example |

As shown in Table 3, it can be seen that the cooling rate of capable of securing the most proper tensile strength and impact toughness even when the specimens are Inventive Wire Rods is in a range of 0.5-1.5° C./s. Therefore, it can be confirmed that the cooling condition can be a preferred condition. That is, Inventive Wire Rods 1-1 an 2-1 which are classified as Comparative Examples did not secure a proper degree of strength, and Inventive Wire Rods 1-5, 2-4, and 2-5 secured a proper degree of strength with insufficient impact toughness.

Example 3

To confirm an effect on strength increase and an effect on impact toughness, Inventive Wire Rod 3 (according to the condition of Tables 1 and 2) and Comparative Wire Rod 6 of Example 1 were prepared.

Comparative Wire Rod 6 includes 0.25 wt % of C and 0.5 wt % of Mn, and was the same in remaining condition as Inventive Wire Rod 3.

Figure 2:
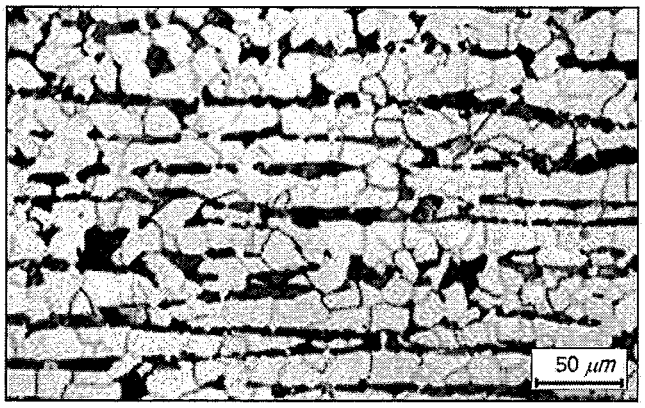
FIG. 2 shows the microstructure of Comparative Wire Rod 6 in Example 2.
Figure 3:
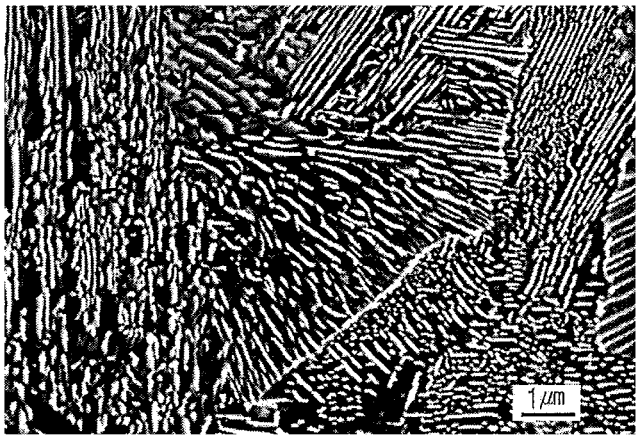
FIG. 3 is a magnified image of pearlite in the photograph of FIG. 1.
Figure 4:
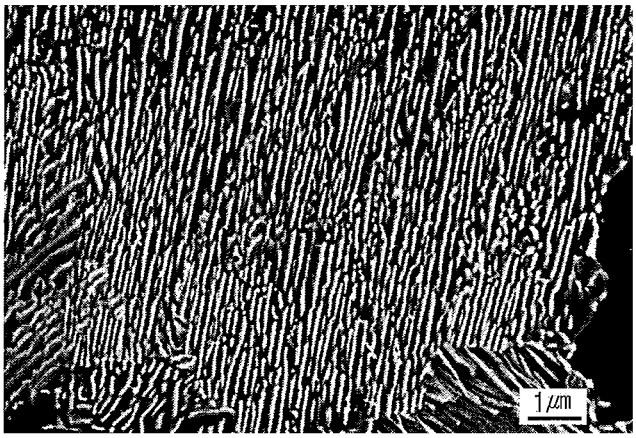
FIG. 4 is a magnified image of pearlite in the photograph of FIG. 2.

Microstructures of Inventive Wire Rod 3 and Comparative Wire Rod 6 were observed and are shown in FIGS. 1 and 2, and magnified photographs thereof are shown in FIGS. 3 and 4, respectively.

FIGS. 1 and 3 show microstructure of Inventive Wire Rod 3, in which black portions indicate de-generated pearlite and white portions indicate ferrite. It can be confirmed that the de-generated pearlite occupies an area fraction of not less than 90%. Also, it can be confirmed from FIG. 3 that ferrite and cementite form a mixed phase, but do not a lamellar structure, unlike typical pearlite.

On the contrary, FIGS. 2 and 4 show microstructure of Comparative Wire Rod 6, i.e., a typical ferrite-based steel sheet. It can be confirmed from FIG. 4 that ferrite occupies an area fraction of about 80%, pearlite occupies an area fraction of about 20%, and the pearlite has a lamellar structure composed of ferrites and cementites.

Figure 5:
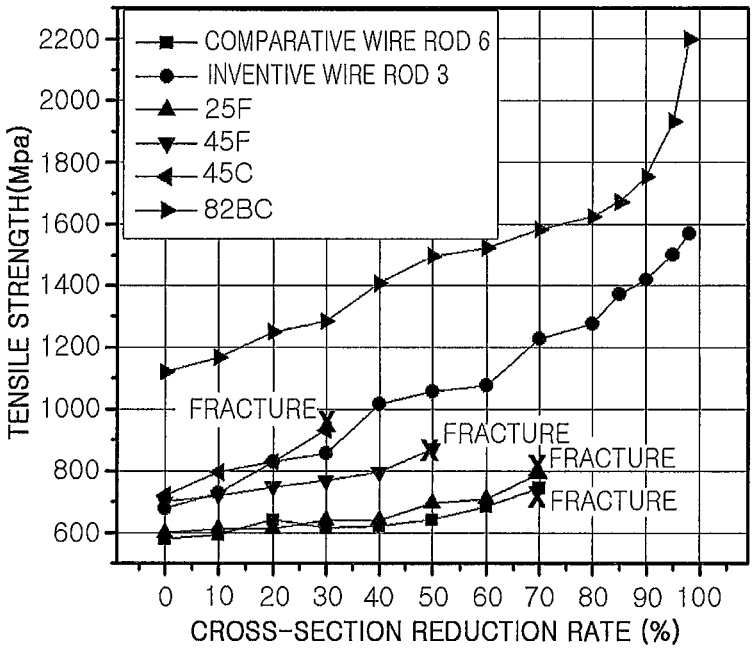
FIG. 5 is a graph showing the measurement of an increase in strength according to the level of cold drawing in Example 2.
Figure 6:
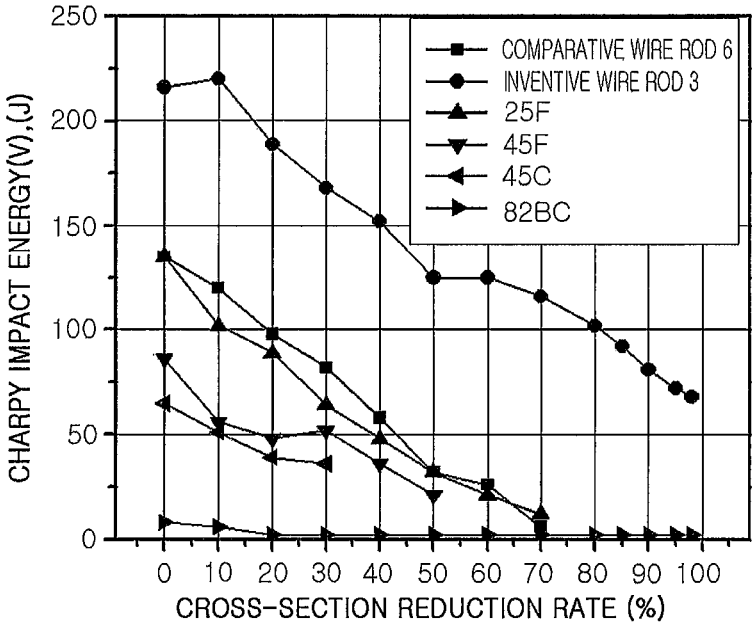
FIG. 6 is a graph showing the measurement of impact toughness according to the level of cold drawing in Example 2.

Meanwhile, strength increase and impact toughness according to cold drawing were observed and shown in FIGS. 5 and 6, respectively. In FIGS. 5 and 6, 25F, 45F, 45C and 82BC indicate 25F steel having a component of 0.25C-0.7Mn-0.2Si, 45F and 45C steels having a component of 0.45C-0.7Mn-0.2Si, and 82BC steel having a component of 0.9C-0.7Mn-0.2Cr, respectively.

As shown in FIG. 5, it can be confirmed that steels other than Inventive Material 3 and 82BC steel increase in tensile strength together with an increase in level of cold drawing and are fractured on the way. Meanwhile, as shown in FIG. 6, while the level of cold drawing increases, Inventive Material 3 has an impact toughness of not less than 60 J even in a cross-section reduction rate of not less than 90%, but other billets are fractured or have very low impact toughness values.

Accordingly, it can be confirmed that only Inventive Material 3 secures excellent strength and at the same time has an excellent impact toughness value while the level of cold drawing is increased.

The invention claimed is:

1. A high toughness cold-drawn non-heat treated wire rod comprising carbon (C): 0.2-0.3%, silicon (Si): 0.1-0.2%, manganese (Mn): 2.5-4.0%, phosphorus (P): 0.035% or less (except 0), sulfur (S): 0.04% or less (except 0), the remainder iron (Fe), and other inevitable impurities, as a percentage by weight, wherein the microstructure of the wire rod is de-generated pearlite having an area fraction of not less than 90%, and ferrite.

2. The high toughness cold-drawn non-heat treated wire rod of claim 1, wherein the de-generated pearlite comprises cementite having a thickness of not more than 100 nm.

3. The high toughness cold-drawn non-heat treated wire rod of claim 1, wherein the de-generated pearlite comprises cementite having an aspect ratio (width:thickness) of 30:1 or less.

4. The high toughness cold-drawn non-heat treated wire rod of claim 1, wherein the wire rod has a tensile strength ranging from 650 Mpa to 750 Mpa.

5. The high toughness cold-drawn non-heat treated wire rod of claim 1, wherein the wire rod has a tensile strength ranging from 1300 Mpa to 1500 Mpa and a V-impact toughness of 60 J or more after cold drawing at a cross-section reduction rate of 90%.

6. A method for manufacturing a high toughness cold-drawn non-heat treated wire rod, comprising:

heating a billet that includes C: 0.2-0.3%, Si: 0.1-0.2%, Mn: 2.5-4.0%, P: 0.035% or less (except 0), S: 0.04% or less (except 0), the remainder Fe, and other inevitable impurities, as a percentage by weight, within a temperature range of $A_{e3}$+150° C. to $A_{e3}$+250° C.;

cooling the heated billet at a cooling rate of 5-15° C./s;

rolling the cooled billet within a temperature range of $A_{e3}$+50° C. to $A_{e3}$+150° C.; and cooling the rolled steel to a temperature of 600° C. or less, wherein, after cooling, the rolled steel has a microstructure of de-generated pearlite having an area fraction of not less than 90% and, ferrite.

7. The method of claim 6, wherein the heating is performed for 30 minutes to 1 and a half hours.

* * * * *